US011323804B2

(12) United States Patent
Chen et al.

(10) Patent No.: US 11,323,804 B2
(45) Date of Patent: May 3, 2022

(54) METHODS, SYSTEMS AND APPARATUS FOR IMPROVED FEEDBACK CONTROL

(71) Applicant: Cirrus Logic International Semiconductor Ltd., Edinburgh (GB)

(72) Inventors: Henry Chen, Glenhuntly (AU); Tom Harvey, Northcote (AU); Brenton Steele, Blackburn South (AU)

(73) Assignee: Cirrus Logic, Inc., Austin, TX (US)

( * ) Notice: Subject to any disclaimer, the term of this patent is extended or adjusted under 35 U.S.C. 154(b) by 153 days.

(21) Appl. No.: 16/774,926

(22) Filed: Jan. 28, 2020

(65) Prior Publication Data

US 2020/0186923 A1 Jun. 11, 2020

Related U.S. Application Data

(63) Continuation of application No. 16/213,294, filed on Dec. 7, 2018, now Pat. No. 10,595,126.

(51) Int. Cl.

| | |
|---|---|
| ***H04R 3/02*** | (2006.01) |
| ***H04R 3/00*** | (2006.01) |
| ***H04R 1/40*** | (2006.01) |
| ***G10L 21/038*** | (2013.01) |

(52) U.S. Cl.

CPC ..... *H04R 3/02* (2013.01); *G10L 21/038* (2013.01); *H04R 1/406* (2013.01); *H04R 3/005* (2013.01)

(58) Field of Classification Search

CPC ..... H04R 3/02; H04R 3/005; H04R 1/406
USPC ..... 381/83, 66, 93, 71.1–71.14
See application file for complete search history.

(56) References Cited

U.S. PATENT DOCUMENTS

| | | | | |
|---|---|---|---|---|
| 10,206,048 | B2 * | 2/2019 | Petersen | H04R 25/407 |
| 10,244,306 | B1 * | 3/2019 | Ku | G10K 11/17833 |
| 2004/0252853 | A1 | 12/2004 | Blamey et al. | |
| 2008/0240414 | A1 * | 10/2008 | Mohammad | H04M 9/082 379/406.08 |
| 2011/0007907 | A1 * | 1/2011 | Park | G10K 11/17881 381/71.8 |

(Continued)

*Primary Examiner* — Disler Paul
(74) *Attorney, Agent, or Firm* — Jackson Walker L.L.P.

(57) ABSTRACT

An apparatus of reducing feedback noise in an acoustic system, the apparatus comprising: a first input for receiving a first signal derived from a first microphone associated with a first channel, the first signal comprising a first set of frequency sub-bands; a second input for receiving a second signal derived from a second microphone associated with a second channel, the second signal comprising second set of frequency sub-bands, the first and second sets of frequency sub-bands having matching frequency ranges, each frequency sub-band of the first and second sets of frequency sub-bands having a frequency of greater than a threshold frequency; and one or more processors configured to: determining feedback at a first speaker associated with the first channel; and responsive to determining feedback, mix each of the first set of frequency sub-bands with a corresponding one of the second set of frequency sub-bands to generate a mixed output signal comprising a mixed set of frequency sub-bands; wherein the mixing is performed so as to minimize the output power in each of the mixed set of frequency sub-bands whilst maintaining a stereo effect level difference in the mixed signal between the first and second signals within a level difference threshold range.

20 Claims, 6 Drawing Sheets

(56) References Cited

U.S. PATENT DOCUMENTS

| | | | | |
|---|---|---|---|---|
| 2012/0207315 | A1 | 8/2012 | Kimura et al. | |
| 2017/0180878 | A1* | 6/2017 | Petersen | H04R 25/305 |
| 2017/0180879 | A1 | 6/2017 | Petersen et al. | |
| 2019/0295563 | A1* | 9/2019 | Kamdar | G10K 11/16 |

* cited by examiner

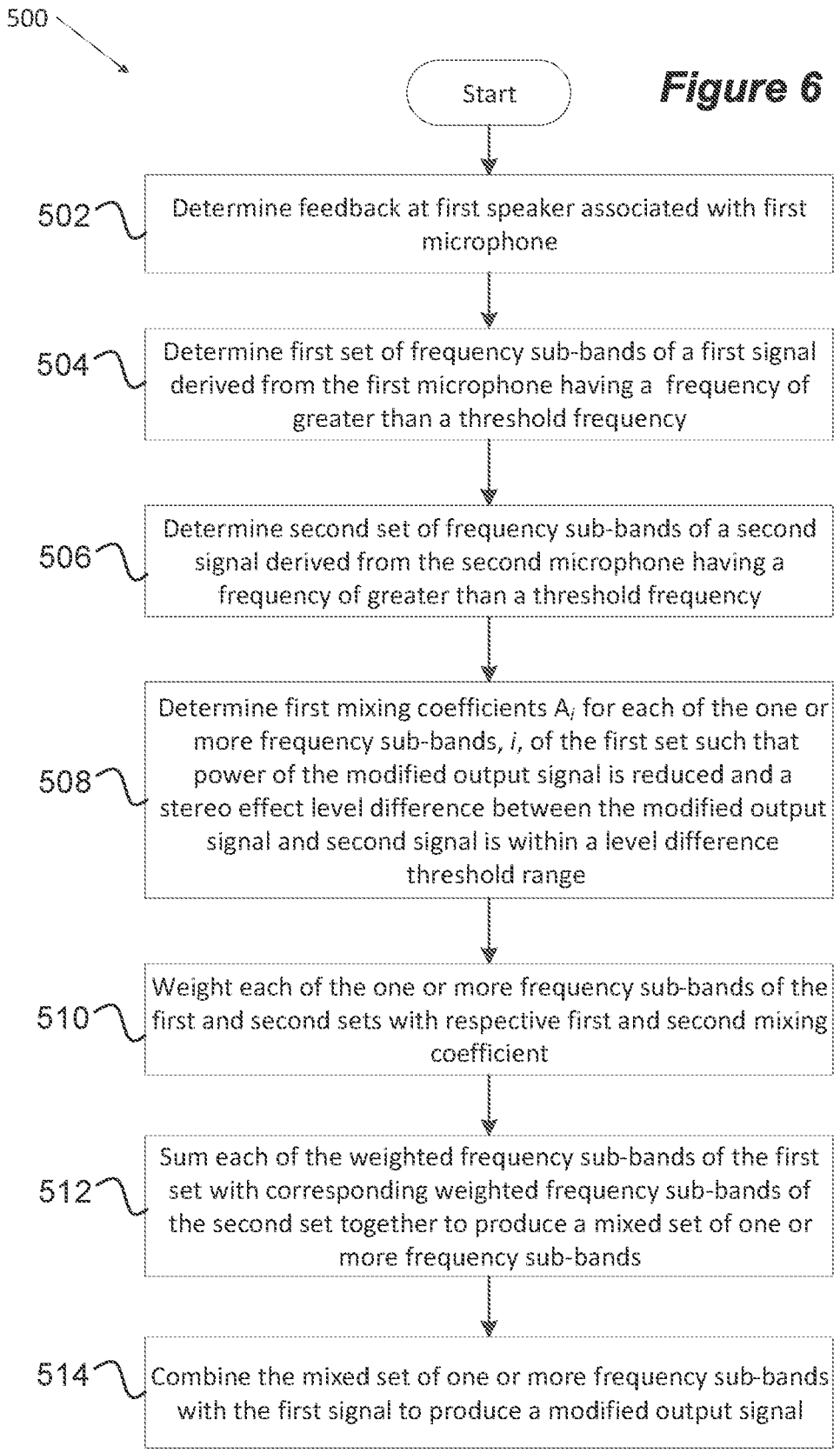
500
Start
Figure 6
502
Determine feedback at first speaker associated with first microphone
504
Determine first set of frequency sub-bands of a first signal derived from the first microphone having a frequency of greater than a threshold frequency
506
Determine second set of frequency sub-bands of a second signal derived from the second microphone having a frequency of greater than a threshold frequency
508
Determine first mixing coefficients $A_i$ for each of the one or more frequency sub-bands, *i*, of the first set such that power of the modified output signal is reduced and a stereo effect level difference between the modified output signal and second signal is within a level difference threshold range
510
Weight each of the one or more frequency sub-bands of the first and second sets with respective first and second mixing coefficient
512
Sum each of the weighted frequency sub-bands of the first set with corresponding weighted frequency sub-bands of the second set together to produce a mixed set of one or more frequency sub-bands
514
Combine the mixed set of one or more frequency sub-bands with the first signal to produce a modified output signal

METHODS, SYSTEMS AND APPARATUS FOR IMPROVED FEEDBACK CONTROL

This application is a continuation of U.S. patent application Ser. No. 16/213,294, filed Dec. 7, 2018, which is incorporated by reference herein in its entirety.

TECHNICAL FIELD

The present disclosure relates to methods, systems and apparatus for improved feedback control in acoustic systems. Some embodiment relate to methods and apparatus for reducing feedback noise in acoustic systems. Some embodiment relate to methods and apparatus for improving feedback cancellation in acoustic systems. Some embodiment relate to methods and apparatus for improving detection of feedback in acoustic systems.

BACKGROUND

In audio systems comprising a microphone and speaker in close proximity, such as the audio system shown in FIG. 1, feedback may occur due to a feedback path between the speaker and the microphone. For example, in audio devices which implement hearing augmentation, an acoustic signal from a speaker may leak from the ear canal and be picked up by a microphone positioned close to the ear.

In audio systems which implement active noise cancellation (ANC), a feedback path is purposefully created to reduce environmental noise. However, when the loop gain of such a feedback path is greater than 1, feedback will build up leading to howling at the speaker.

Known passive feedback management techniques used to address such feedback include modifying acoustics (attenuating the acoustic feedback path) or reducing gain (attenuating the electrical feedback path). In current generation ANC headsets with talk-through, low-pass filters are typically applied so that no gain is applied above 2 kHz.

Known active feedback management techniques for hearing augmentation include feedback suppression and feedback cancellation. However, both of these techniques have drawbacks. For example, active feedback suppression may allow short bursts of feedback before suppression is applied. Additionally, active feedback suppression leads to a reduction in gain in the hearing augmentation path. Active feedback cancellation may only model a linear feedback path and is limited in its performance by reverberation.

Other feedback management techniques include techniques for reducing feedback noise, for example, by microphone signal mixing. However, microphone signal mixing may corrupt binaural or stereo cues being delivered to a user.

It is desired to address or ameliorate one or more shortcomings of known feedback management techniques, or to at least provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

An apparatus of reducing feedback noise in an acoustic system, the apparatus comprising: a first input for receiving a first signal derived from a first microphone associated with a first channel, the first signal comprising a first set of frequency sub-bands; a second input for receiving a second signal derived from a second microphone associated with a second channel, the second signal comprising second set of frequency sub-bands, the first and second sets of frequency sub-bands having matching frequency ranges, each frequency sub-band of the first and second sets of frequency sub-bands having a frequency of greater than a threshold frequency; and one or more processors configured to: determining feedback at a first speaker associated with the first channel; and responsive to determining feedback, mix each of the first set of frequency sub-bands with a corresponding one of the second set of frequency sub-bands to generate a mixed output signal comprising a mixed set of frequency sub-bands; wherein the mixing is performed so as to minimize the output power in each of the mixed set of frequency sub-bands whilst maintaining a stereo effect level difference in the mixed signal between the first and second signals within a level difference threshold range.

The mixing may comprise: determining first mixing coefficients Ai for each of the first set of frequency sub-bands, where Ai is equal to or less than 1; determining second mixing coefficients 1−Ai for each of the second sets of frequency sub-bands; weighting each of the one or more frequency sub-bands of the first set with respective first mixing coefficients Ai and weighting each of the corresponding frequency sub-bands of the second set with respective second mixing coefficients, 1−Ai; and summing each of the weighted one or more frequency sub-bands of the first set with corresponding weighted frequency sub-bands of the second set together to produce the mixed set of one or more frequency sub-bands.

The one or more processors may be further configured to determine the first set of frequency sub-bands and the second set of frequency sub-bands.

The threshold frequency may be about 2000 Hz.

The level difference threshold range may be between about 6 dB to about 12 dB.

The one or more processors may be further configured to determine the first mixing coefficient Ai and the second mixing coefficient, 1−Ai, The first mixing coefficient Ai may be defined as:

$$A = \frac{skew^2 * \Sigma|m2|^2 - \text{skew} * \text{real}(\Sigma m1 * \overline{m2}) + eps}{\Sigma|m1|^2 - 2 * \text{skew} * \text{real}(\Sigma m1 * \overline{m2}) + skew^2 * \Sigma|m2|^2 + eps}$$

where $m1_i$ is the first set of frequency sub-bands, $m2_i$ is the second set of frequency sub-bands, eps is a constant defining the minimum subband power for which mixing occurs, and skew is a skew factor for maintaining the stereo effect level difference in the mixed signal between the first and second signals within the level difference threshold range.

Determining feedback at the first speaker may comprise determining a first probability, p1, of feedback at the first speaker; and the one or more processors are further configured to: determine a second probability of feedback at a second speaker associated with the second channel.

The one or more processors may be further configured to determine the first mixing coefficient Ai and the second mixing coefficient, 1−Ai. The first mixing coefficient Ai may be defined as:

$$A_i = \frac{\Sigma|p2*m2|^2 - \text{real}(\Sigma p1*m2*\overline{p2*m2}) + eps}{\Sigma|p1*m1|^2 - 2*\text{real}(\Sigma p1*m1*\overline{p2*m2}) + \Sigma|p2*m2|^2 + eps}$$

wherein p1 is the first probability, p2 is the second probability, $m1_i$ is the first set of frequency sub-bands, $m2_i$ is the second set of frequency sub-bands, and eps is a constant defining the minimum subband power for which mixing occurs.

Determining feedback at the first speaker may comprise: determining a first level difference between a level of at least one high frequency sub-band of the first signal and a corresponding high frequency sub-band of a second signal; and determining the first probability based on the first level difference.

Determining feedback at the first speaker may comprise: determining a second level difference between a level of at least one high frequency sub-band of a first signal and a corresponding high frequency sub-band of a third signal derived from a third microphone, the third microphone in close proximity to the first speaker.

The at least one high frequency sub-band of the first signal may comprise a first plurality of sub-bands and the at least one high frequency sub-band of the second channel comprises a second plurality of sub-bands. Determining feedback at the first speaker may further comprise: determining a set of level differences between each of the first plurality of sub-bands and a corresponding one of the second plurality of sub-bands; and determining the first probability based on the first set of level differences.

Determining the first probability may comprise: determining a mean of the determined set of level differences; determining a minimum value of the determined set of level differences; determining a level difference feature based on the mean of the determined set of level differences subtracted by the minimum value of the determined set of level differences; and determining the first probability based on the level difference feature.

The one or more processors may be further configured to: determine a first level difference between a level of at least one high frequency sub-band of the first signal and a corresponding high frequency sub-band of the second signal; determine a second level difference between a level of at least one low frequency sub-band of the first signal and a corresponding relatively low frequency sub-band of the second signal; determine a modified level difference by subtracting the second level difference from the first level difference; and determine the first probability based on the modified level difference.

The one or more processors may be further configured to: combine the mixed set of one or more frequency sub-bands with a third set of frequency sub-bands of the first signal to provide a combined set of frequency sub-bands, wherein each frequency sub-band of the third set of frequency sub-bands has a frequency of less than or equal to the threshold frequency; and transform the combined set of frequency sub-bands into a time domain output signal.

The first and second microphones may be either (i) reference microphones configured to capture ambient sounds or (ii) error microphones configured to capture sound in respective first and second channels.

Determining feedback at the first speaker may comprise receiving a feedback flag indicative of feedback detected at the first speaker.

One of the first and second microphones may be a first reference microphone associated with the first speaker and configured to capture ambient sound in proximity to the first speaker. The other of the first and second microphones may be a reference microphone associated with a second speaker and configured to capture sound in proximity to the respective second speaker.

According to another aspect of the disclosure, there is provided a system comprising: the apparatus as described above; the first microphone; the second microphone; and the first speaker.

According to another aspect of the disclosure, there is provided an electronic device comprising the apparatus or system as described above. The electronic device may be: a mobile phone, for example a smartphone; a media playback device, for example an audio player; or a mobile computing platform, for example a laptop or tablet computer.

According to another aspect of the disclosure, there is provided a method of reducing feedback noise in an acoustic system, the method comprising: receiving a first signal derived from a first microphone associated with a first channel, the first signal comprising a first set of frequency sub-bands; receiving a second signal derived from a second microphone associated with a second channel, the second signal comprising second set of frequency sub-bands, the first and second sets of frequency sub-bands having matching frequency ranges, each frequency sub-band of the first and second sets of frequency sub-bands having a frequency of greater than a threshold frequency; responsive to determining feedback at a first speaker associated with the first channel; mixing each of the first set of frequency sub-bands with a corresponding one of the second set of frequency sub-bands to generate a mixed output signal comprising a mixed set of frequency sub-bands; wherein the mixing is performed so as to minimize the output power in each of the mixed set of frequency sub-bands whilst maintaining a stereo effect level difference in the mixed signal between the first and second signals within a level difference threshold range.

The mixing may comprise: determining first mixing coefficients Ai for each of the first set of frequency sub-bands, where Ai is equal to or less than 1; determining second mixing coefficients 1−Ai for each of the second sets of frequency sub-bands; weighting each of the one or more frequency sub-bands of the first set with respective first mixing coefficients Ai and weighting each of the corresponding frequency sub-bands of the second set with respective second mixing coefficients, 1−Ai; and summing each of the weighted one or more frequency sub-bands of the first set with corresponding weighted frequency sub-bands of the second set together to produce the mixed set of one or more frequency sub-bands.

The method may further comprise determining the first set of frequency sub-bands and the second set of frequency sub-bands.

The threshold frequency may be about 2000 Hz. The level difference threshold range may be between about 6 dB to about 12 dB.

The first mixing coefficient Ai for each of the frequency sub-bands, i, of the first set may be defined as:

$$A = \frac{skew^2*\Sigma|m2|^2 - \text{skew}*\text{real}(\Sigma m1*\overline{m2}) + eps}{\Sigma|m1|^2 - 2*\text{skew}*\text{real}(\Sigma m1*\overline{m2}) + skew^2*\Sigma|m2|^2 + eps}$$

where $m1_i$ is the first set of frequency sub-bands, $m2_i$ is the second set of frequency sub-bands, eps is a constant defining the minimum subband power for which mixing occurs, and skew is a skew factor for maintaining the stereo effect level difference in the mixed signal between the first and second signals within the level difference threshold range.

Determining feedback at the first speaker may comprise determining a first probability, p1, of feedback at the first speaker; and the method further comprises: determining a second probability of feedback at a second speaker associated with the second channel.

The first mixing coefficient Ai for each of the frequency sub-bands of the first set may be defined as:

$$A_i = \frac{\Sigma|p2*m2|^2 - \mathrm{real}(\Sigma p1*m2*\overline{p2*m2}) + eps}{\Sigma|p1*m1|^2 - 2*\mathrm{real}(\Sigma p1*m1*\overline{p2*m2}) + \Sigma|p2*m2|^2 + eps}$$

wherein p1 is the first probability, p2 is the second probability, $m1_i$ is the first set of frequency sub-bands, $m2_i$ is the second set of frequency sub-bands, and eps is a constant defining the minimum subband power for which mixing occurs.

Determining feedback at the first speaker may comprise determining a first level difference between a level of at least one high frequency sub-band of the first signal and a corresponding high frequency sub-band of a second signal; and determining the first probability based on the first level difference.

Determining feedback at the first speaker may comprise: determining a second level difference between a level of at least one high frequency sub-band of a first signal and a corresponding high frequency sub-band of a third signal derived from a third microphone, the third microphone in close proximity to the first speaker.

The at least one high frequency sub-band of the first signal may comprise a first plurality of sub-bands. The at least one high frequency sub-band of the second channel comprises a second plurality of sub-bands. Determining feedback at the first speaker further comprises: determining a set of level differences between each of the first plurality of sub-bands and a corresponding one of the second plurality of sub-bands; and determining the first probability based on the first set of level differences.

Determining the first probability comprises: determining a mean of the determined set of level differences; determining a minimum value of the determined set of level differences; determining a level difference feature based on the mean of the determined set of level differences subtracted by the minimum value of the determined set of level differences; and determining the first probability based on the level difference feature.

The method may further comprise determining a first level difference between a level of at least one high frequency sub-band of the first signal and a corresponding high frequency sub-band of the second signal; determining a second level difference between a level of at least one low frequency sub-band of the first signal and a corresponding relatively low frequency sub-band of the second signal; determining a modified level difference by subtracting the second level difference from the first level difference; and determining the first probability based on the modified level difference.

The method may further comprise: combining the mixed set of one or more frequency sub-bands with a third set of frequency sub-bands of the first signal to provide a combined set of frequency sub-bands, wherein each frequency sub-band of the third set of frequency sub-bands has a frequency of less than or equal to the threshold frequency; and transforming the combined set of frequency sub-bands into a time domain output signal.

The first and second microphones may be (i) reference microphones configured to capture ambient sounds or (ii) error microphones configured to capture sound in respective first and second channels.

Determining feedback at the first speaker comprises receiving a feedback flag indicative of feedback detected at the first speaker.

One of the first and second microphones may be a first reference microphone associated with the first speaker and configured to capture ambient sound in proximity to the first speaker. The other of the first and second microphones may be a reference microphone associated with a second speaker and configured to capture sound in proximity to the respective second speaker.

According to another aspect of the disclosure, there is provided a non-transitory computer-readable storage medium comprising instructions which, when executed by a computer, cause the computer to carry out the method described above.

According to another aspect of the disclosure, there is provided a feedback canceller, comprising: a first input for receiving a first signal derived from a first microphone associated with a first channel; a second input for receiving a first probability of feedback between the first microphone and a first speaker; a normalised least mean squares (NLMS) filter or least mean squares (LMS) filter configured to filter the first signal and output a filtered first signal; a controller configured to control an adaption rate of the NLMS filter or the LMS filter in dependence of the first probability of feedback.

The controller may be configured to increase the adaption rate of the NLMS filter or the LMS filter as the first probability of feedback increases.

The controller may be configured to control the adaption rate, μ, using the following equation:

$$\mu = \mathrm{Max}(\mathrm{fbc_slow_rate}, (\mathrm{fbc_fast_rate} + \mathrm{logProb}))$$

where fbc_slow_rate is a lower bound of the adaption rate, fbc_fast_rate is an upper bound of the adaptation rate, and logProb is the log of the first probability.

According to another aspect of the disclosure, there is provided a method of cancelling feedback, comprising: receiving a first signal derived from a first microphone associated with a first channel; receiving a first probability of feedback between the first microphone and a first speaker; filtering the first signal with a normalised least mean squares (NLMS) filter or least mean squares (LMS) filter and outputting a filtered first signal; wherein an adaption rate of the NLMS filter or LMS filter is controlled in dependence of the first probability of feedback.

The adaption rate of the NLMS filter or LMS filter may be increased as the first probability of feedback increases.

The adaption rate, μ, may be controlled based on the following equation:

$$\mu = \mathrm{Max}(\mathrm{fbc_slow_rate}, (\mathrm{fbc_fast_rate} + \mathrm{logProb}))$$

where fbc_slow_rate is a lower bound of the adaption rate, fbc_fast_rate is an upper bound of the adaptation rate, and logProb is the log of the first probability.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

By way of example only, embodiments are now described with reference to the accompanying drawings, in which:

FIG. 6 is a process flow diagram depicting a method for reducing feedback in an acoustic system;

DESCRIPTION OF EMBODIMENTS

Described embodiments relate to methods, systems and apparatus for improved feedback control in an acoustic system. Described embodiments may reduce or eliminate incidences of feedback noise, such as howling when the acoustic path changes and/or improve added stable gain in ANC headset form factors.

Some embodiments relate to methods and apparatus for improved detection of feedback in acoustic systems. For example, some embodiments relate to determining an improved estimation of the likelihood or probability of feedback. By improving the detection of feedback in acoustic systems, feedback management techniques, such as feedback cancellation or suppression techniques, may be improved to thereby enhance the sound quality of the system. Similarly, by improving the detection of feedback in acoustic systems, feedback noise reduction techniques, such as microphone signal mixing techniques, may be improved to thereby enhance the sound quality of the system.

Some embodiment relate to methods and apparatus for reducing feedback noise in an acoustic system. For example, feedback reduction mechanisms, according to described embodiments, may instigate sub-band mixing in response to determining that feedback is present at a first speaker associated with a first microphone.

Some embodiment relate to methods and apparatus for improving feedback cancellation in an acoustic system. For example, feedback control mechanisms, according to described embodiments, may be used to perform improved feedback cancellation by adjusting an adaptation rate of the feedback cancellation being or to be performed in response to determining that feedback is present at a first speaker associated with a first microphone.

Figure 1:
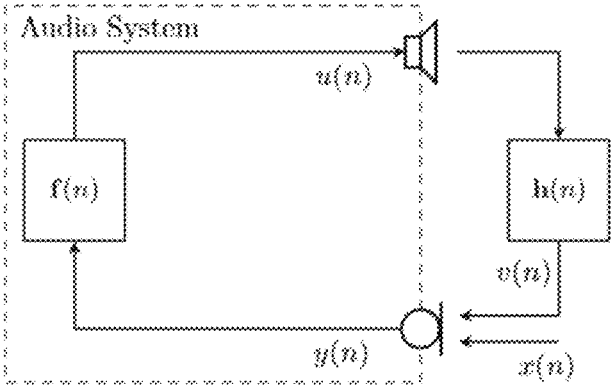
Figure 1 (prior art)
FIG. 1 is a schematic diagram illustrating feedback in an acoustic system.
Figure 2A:
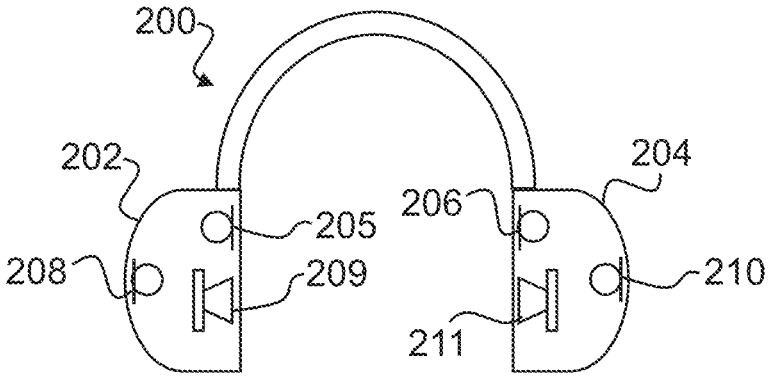
FIG. 2*a* is a schematic illustration of an audio system comprising a pair of audio modules.

FIG. 2*a* illustrates a system 200 in which improved feedback control may be implemented. It will be appreciated that methods described herein may be implemented on any system comprising two microphones, one of which is associated with a speaker such that a feedback path exists between one of the two microphones and the speaker, and such methods may improve the control of such a feedback path.

The system 200 shown in FIG. 2*a* comprises two modules 202 and 204. The modules 202, 204 may be connected, wirelessly or otherwise. Each module 202, 204 comprises an error microphone 205, 206, a reference microphone 208, 210, and a speaker 209, 211 respectively. The reference microphones 208, 210 are positioned so as to sense ambient noise from outside the ear canal and outside of the headset. Conversely, the error microphones 205, 206 are positioned, in use, towards the ear so as to sense acoustic sound within the ear canal including the output of the respective speakers 209, 211. The speakers 209, 211 are provided primarily to deliver sound to the ear canal of the user. The system 200 may be configured for a user to listen to music or audio, to make telephone calls, and/or to deliver voice commands to a voice recognition system, and other such audio processing functions.

Figure 2B:
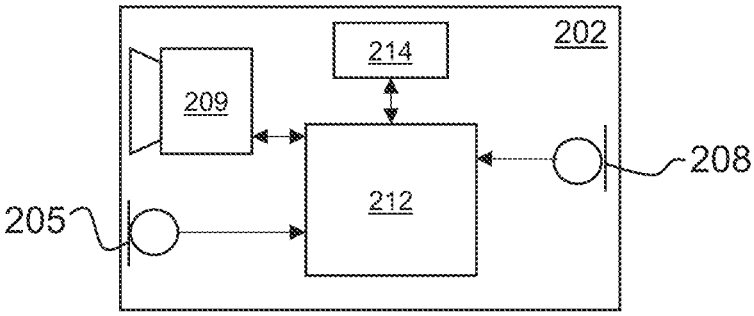
FIG. 2*b* is a block diagram showing one of the pair of audio modules shown in FIG. 2*a* in more detail.

FIG. 2*b* is a system schematic of the first module 202 of the headset. The second module 204 is configured in substantially the same manner as the first module 202 and is thus not separately shown or described.

The first module 202 may comprise a digital signal processor (DSP) 212 configured to receive microphone signals from error and reference microphones 205, 208. The module 202 may further comprise a memory 214, which may be provided as a single component or as multiple components. The memory 214 is provided for storing data and program instructions. The module 202 may further comprise a transceiver 216 to enable the module 202 to communicate wirelessly with external devices, such as the second module 204. Such communications between the modules 202, 204 may in alternative embodiments comprise wired communications where suitable wires are provided between left and right sides of a headset, either directly such as within an overhead band, or via an intermediate device such as a smartphone. The module 202 may be powered by a battery and may comprise other sensors (not shown).

Figure 3:
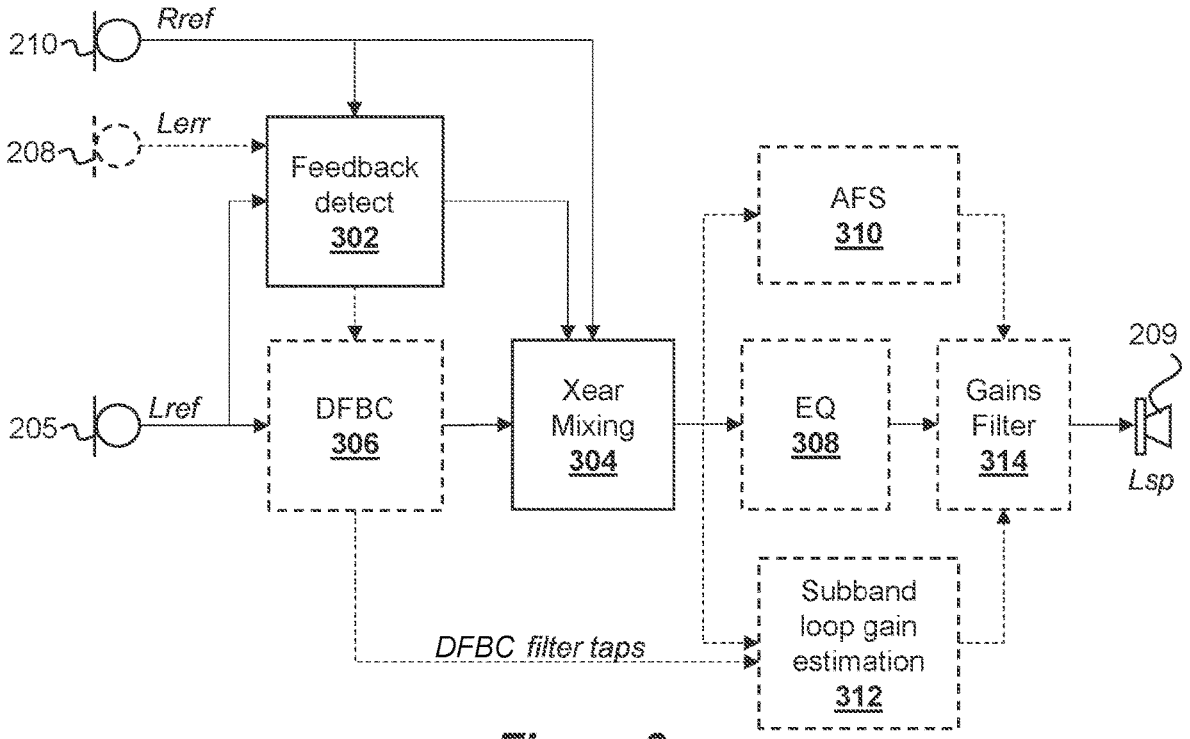
FIG. 3 is a schematic diagram of a system for providing improved feedback control.

FIG. 3 is a block diagram of a feedback reduction system 300 which may be implemented by the system 200 shown in FIG. 2*a* or any other system comprising at least two microphones (e.g. left and right channel microphones 205, 210) and a speaker. In some embodiments, the feedback reduction system 300 may be implemented using a DSP such as the DSP 212.

The feedback reduction system 300 will be described with reference to the first module 202 shown in FIG. 2*b*. The feedback reduction system 300 is configured to reduce feedback in a single channel, in this instance a left channel. It will be appreciated that in systems comprising two channels, the feedback reduction system 300 may be duplicated for the second channel, e.g. the right channel, or the feedback reduction system 300 may receive inputs from the right channel in a similar manner to that described herein for the left channel.

The feedback reduction system 300 comprises a feedback detection module 302 and a cross-ear mixing module 304. Optionally, the feedback reduction system 300 also comprises a digital feedback cancellation (DI-BC) module 306, an equalisation (EQ) module 308, an active feedback suppression (AFS) module 310, a subband loop gain estimation module 312 and a gains filter 314.

The feedback detection module 302 is configured to detect a feedback condition and to provide a feedback detection output to the cross-ear mixing module 304. In some embodiments such an output may be an indicator of the likelihood or probability of feedback. Additionally or alternatively, the output may be a binary flag indicative of the presence or absence of feedback noise, such as howling at the speaker 209.

The feedback detection module 302 may also be configured to provide a feedback detection output to the DFBC module 306 (if present) to improve control of feedback cancellation. In some embodiments, the DFBC module 306 may be configured to perform feedback cancellation and the feedback detection output from the feedback detection module 302 may be used by the DFBC module 306 to adjust an adaptation rate of the feedback cancellation being or to be performed. For example, the DFBC module 306 may control the adaption rate based on the probability of feedback calculated by the feedback detection module 302. Further details of the DFBC module 306 and the feedback detection module 302 are provided below.

The cross-ear mixing module 304 may be configured to generate a modified output signal by mixing components of the left and right reference microphone signals 205, 210 in dependence of those signals. Such mixing may reduce unwanted feedback, such as howling.

The modified output signal from the cross-ear mixing module 304 may optionally then be equalised by the EQ module 308 and gain adjusted by the gain filter 314 (again optionally) before being output to the first speaker 209. If implemented, the gains filter 314 receives inputs from the AFS module 310 and/or the subband loop gain estimation module 312. The AFS module 310 may generate sub-band gains suitable for feedback suppression in accordance with known techniques, such as those described in US patent application publication number US 2004/0252853 A1, the content of which is hereby incorporated by reference in its entirety. Equally, the subband loop gain estimation module 312 may generate sub-band gains to maintain subband loop gain below 1 in order to minimize howling. Having a feedback loop gain greater than 1 can cause the system 200 to become unstable, leading to howling. Sub-band gains from each of the AFS module 310 and the subband loop gain estimation module 312 may then be combined (e.g. summed) to generate a combined gain to be applied by the gains filter 314. In the example shown in FIG. 3, the gains filter 314 filters the signal output from the EQ module 308. In other embodiments, the gains filter 314 may be coupled to and receive signals from the cross ear mixing module 304. In which case, the gains filter 314 may filter the mixed signal output from the cross-ear mixing module 304 and output a filtered signal based on that signal. The gains filter 314 may be applied to any of the above signals either in the frequency domain or the time domain depending on implementation and design constraints.

Figure 3A:
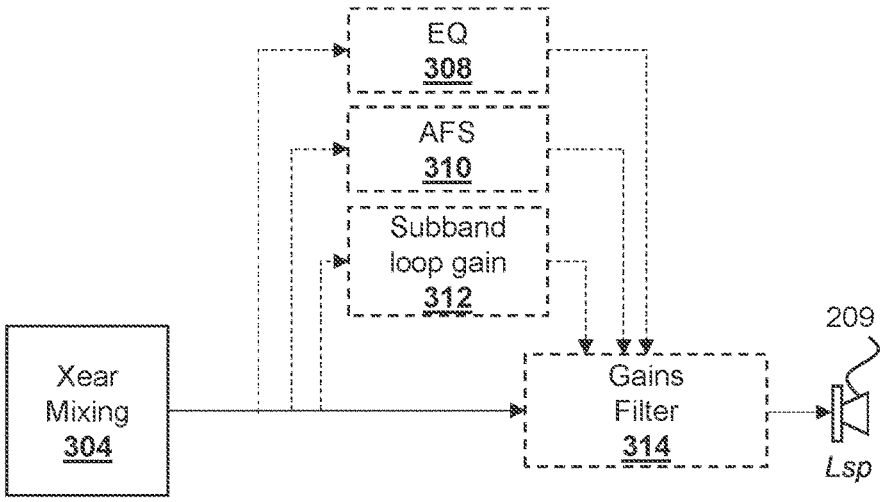
FIG. 3*a* is a schematic diagram showing a variation of the system shown in FIG. 3.

In the embodiment shown in FIG. 3, the gains filter 314 applies gain based on outputs from the AFS module 310 and the subband loop gain estimation module 312. In a variation of the above configuration shown in FIG. 3*a* (shown in part for simplicity), the gains filter 314 is coupled to the output of the cross ear mixing module 304 and receives inputs from the AFS module 310, the EQ module 308, and the subband loop gain module 312. The gains filter 314 is then configured to either filter (if operating in the time domain) or apply subband gains (if operating in the frequency domain) to the signal output from the cross ear mixing module 304.

Figure 4:
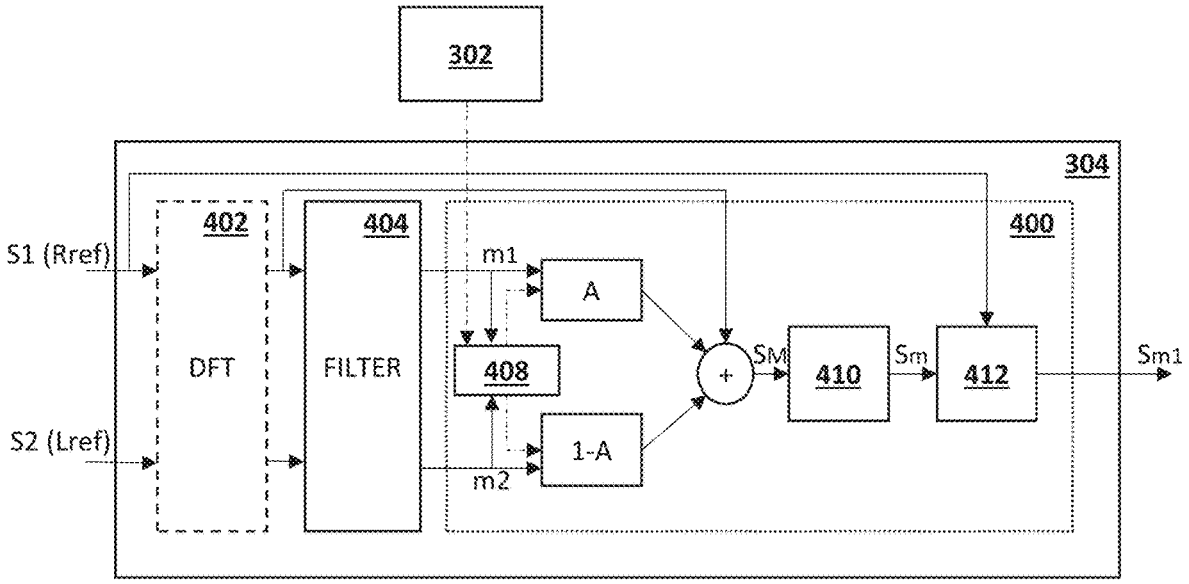
FIG. 4 is a schematic illustration of a cross-ear mixing module.

FIG. 4 illustrates an exemplary embodiment of the cross-ear mixing module 304 shown in FIG. 3. The cross-ear mixing module 304 is configured to receive a first signal $S_1$ derived from a first microphone (not shown) and a second signal $S_2$ derived from a second microphone (not shown) of an acoustic system, such as the system 200 of FIG. 2.

The cross-ear mixing module 304 comprises a mixing module 400. In some embodiments, for example where the first and second signals $S_1$, $S_2$ are provided to the cross-ear mixing module 304 in the time domain, the cross-ear mixing module 304 may further comprise a DFT module 402. The DFT module 402 is configured to convert the first and second signals, $S_1$, $S_2$, from the time domain into the frequency domain, generating frequency domain representations $S_{1F}$, $S_{2F}$ of the first and second signals $S_1$, $S_2$ respectively, each comprising a plurality of frequency sub-bands. The frequency ranges of sub-bands of the converted first signal $S_{1F}$ are chosen to correspond to the frequency ranges of the sub-bands of the converted second signal $S_{2F}$. The DFT module 402 may employ Discrete Fourier Transform (DFT), such as Fast Fourier Transform (FFT), or any other suitable method of conversion between time and frequency domains.

In other embodiments, the first and second signals $S_1$, $S_2$ may be provided in the frequency domain. In which case, the DFT module 402 may be omitted.

In some embodiments the mixing module 400 further comprises a filter module 404 configured to receive the converted frequency domain versions of the first and second signals $S_{1F}$, $S_{2F}$ and determine a first filtered subset of frequency sub-bands $m_1$ wherein the frequency of each of the sub-bands has a frequency of greater than a threshold frequency.

The threshold frequency may be selected to identify frequency sub-bands of the first signal $S_1$ and/or the second signal $S_2$ that may be affected by feedback, such as howling, i.e., candidate feedback affected sub-bands. In some embodiment, the threshold frequency is about 2 kHz or about 3 kHz.

In some embodiments, the filter 404 is a 64 tap linear phase FIR filter. In other embodiments, the filter is an asymmetric window function filter, which is generally associated with a reduced delay compared to a 64 tap linear phase FIR filter. For example, a 64 tap linear phase FIR filter may introduce a 4 ms delay to the system, whereas a asymmetric window function filter may introduce about a 1.5 ms delay to the system. In some embodiments, the filter 404 may be implemented by the DFT module 402. In which case, the DFT module 402 may only convert sub-bands having frequency ranges above the threshold frequency, discarding components of the frequency domain signal having a frequency less than the threshold frequency.

The mixing module 400 is configured to determine a modified output signal $S_{m1}$ in which feedback affected sub-bands of the first filtered subset of frequency sub-bands $m_1$ have been mixed with corresponding sub-bands of the second filtered subset of frequency sub-bands $m_2$. The result of the mixing is a modified output signal $S_M$ having a reduced power compared with the first signal $S_1$ and a stereo effect level difference between the modified output signal $S_M$ and second signal $S_2$ that is within a predetermined level difference threshold.

By reducing the output power in the modified output signal $S_M$, the feedback path gain is reduced. Additionally, when implemented in a stereo system such as the system 200 shown in FIG. 2*a*, when the first and second signals $S_1$, $S_2$ from first and second reference microphones 208, 210 are mixed together, correlation between the first speaker associated with the first reference microphone and the modified output signal is reduced, thereby reducing the likelihood of feedback. Yet further, by producing a modified output signal $S_M$ wherein a level difference between the first and second signals is substantially maintained or provided for, the intended stereo cues or stereo cues substantially similar to those present in the first and second signals can still be delivered to the user.

The mixing module 400 comprises a mixing ratio module 408 configured to determine a mixing coefficient $A_i$ for each frequency sub-band of the first set of frequency sub-bands, $m_1$. For each channel, the mixing coefficient $A_i$ defines how much of the corresponding subband of the other channel is substituted (mixed) into the output signal. The mixing ratio module 408 is configured to determine mixing coefficients $A_i$ for each sub-band i of the first set of frequency sub-bands $m_1$ using minimum power criteria, while substantially maintaining, or mitigating the loss of, stereo cues between the first signal $S_1$ and the second signal $S_2$ in the modified output signal $S_M$.

For example, in some embodiments, the mixing coefficients $A_i$ for each sub-band i are selected such that when a sub-band of the first signal $S_1$ is much louder than the corresponding sub-band of the second signal $S_2$ the corresponding sub-band of the second signal $S_2$, which has less power, will be mostly used as the corresponding sub-band of the modified output signal $S_M$. Conversely, when a signal level of a sub-band of the first signal $S_1$ is relatively low, the mixing coefficient $A_i$ may be selected to be equal to or approach 1, meaning that that sub-band of the first signal $S_1$ will be mostly used as the corresponding sub-band of the modified output signal, $S_M$.

It will be appreciated that mixing of the first and second signals $S_1$, $S_2$ may cause a reduction in stereo cues in the modified output signal $S_M$. To address this, in some embodiments, stereo cues between the modified output signal and the second signal are provided for or maintained by incorporating a skew factor, skew, into the mixing coefficient $A_i$. For example, the skew factor may be selected to ensure that any change to the stereo effect level difference between the first signal and the second signal in the modified output signal $S_M$ is within a threshold level, or that a stereo effect level difference between sub-bands of the modified output signal $S_M$ and corresponding sub-bands of the second signal is within a level difference threshold range.

In some embodiments, the mixing coefficient $A_i$ for each sub-band i is defined as follows:

$$A_i = \frac{skew^2 * \Sigma|m2_i|^2 - \text{skew} * \text{real}(\Sigma m1_i * \overline{m2_i}) + eps}{\Sigma|m1_i|^2 - 2 * \text{skew} * \text{real}(\Sigma m1_i * \overline{m2_i}) + skew^2 * \Sigma|m2_i|^2 + eps}$$

where skew is the skew factor, $m1_i$ is the first filtered subset of frequency sub-bands, $m2_i$ is the second filtered subset of frequency sub-bands. eps is a constant defining the minimum subband power for which mixing occurs, the threshold power level at which mixing occurs increasing with eps.

Figure 5:
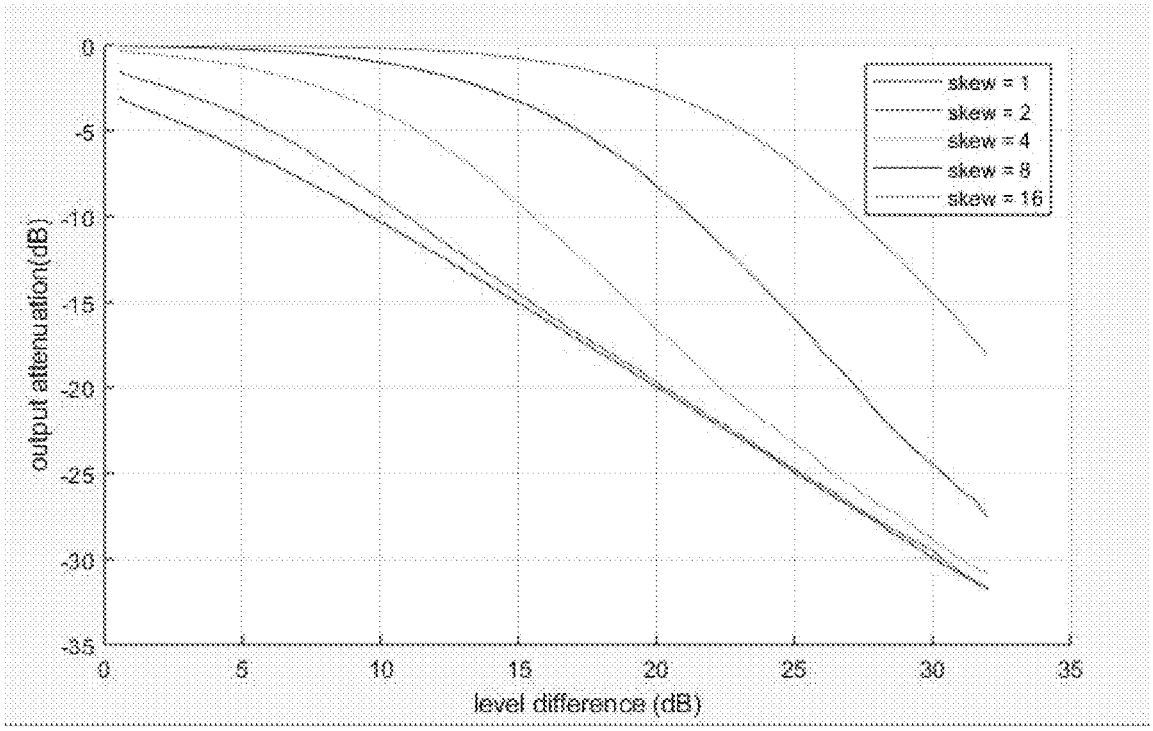
FIG. 5 is a plot of attenuation (dB) of modified output signals from the cross-ear mixing module of FIG. 4 and level difference (dB) between first and second signals provided as inputs to the cross-ear mixing module of FIG. 4.

FIG. 5 graphically illustrates attenuation (dB) of modified output signals $S_M$ modified by the cross-ear mixing module 304 (Y-axis) against level difference (dB) between first and second signals $S_1$, $S_2$ provided as inputs to the cross-ear mixing module 304 (X-axis). The output attenuation is plotted against level difference for different skew factors from 1 (bottom most curve) to 16 (top most curve). The plot illustrates how the skew factor affects the modified output signal $S_M$ output from the cross-ear mixing module 304. As shown, as the skew value increases, there is less attenuation to the modified output signal $S_M$. The correlation between skew factor and attenuation is accentuated for relatively high level differences between the first and second signals (e.g. more than 20 dB). So for high values of skew factor attenuation will be minimized and stereo cues maintained. Conversely for low values of skew factor attenuation will be maximized but stereo cues substantially lost due to large attenuation of one channel or the other.

However, although a relatively high skew factor will cause less attenuation of the modified output signal $S_M$ particularly for relatively high level differences, the higher the skew factor, the greater the value of the mixing coefficient $A_i$ which in turn causes a greater portion of the first signal $m1_i$ to be mixed with the second signal, m2 in determining the modified output signal $S_M$. Accordingly, the modified output signal, $S_M$, may retain a greater amount of howling or feedback noise than if a lower skew factor value were used.

The value for the skew factor is selected to counteract feedback noise, while providing for or retaining stereo cues, and a selection of a suitable skew factor is effectively balancing tolerable noise and sufficient stereo cue maintenance. The skew factor may be predefined and/or adjustable to suit a user's needs depending on the user's tolerance to feedback noise. In some embodiments, an input may be provided for the user to adjust the skew factor (directly or indirectly) to their specific requirements.

In some embodiments, the skew factor may be selected to maintain a level difference of between about 6 to 12 dB between the modified output signal and the second signal. In some embodiments, to determine a suitable skew factor, the level difference between the first and second signals in a non-noise effected subband is measured.

An alternative method of determining the mixing coefficient $A_i$ will now be described. In this embodiment, the microphone signals are dynamically mixed in a way that the output power is minimised during feedback. Feedback howling in headsets tends to occur only on one side of the head, such that left side howling and right side howling are largely uncorrelated. As mentioned above, the feedback detection module 302 may determine a probability of feedback at each of the left and right reference microphones 208, 210. The probability of feedback in the left and right channels may be used to determine the mixing coefficient $A_i$ used by the mixing module 400 as described in more detail below. In some embodiments, the mixing coefficient $A_i$ for the left channel is determined, using the following equation.

$$A_i = \frac{\Sigma|p2 * m2_i|^2 - \text{real}(\Sigma p1 * m1_i * \overline{p2 * m2_i}) + eps}{\Sigma|p1 * m1_i|^2 - 2 * \text{real}(\Sigma p1 * m1_i * \overline{p2 * m2_i}) + \Sigma|p2 * m2_i|^2 + eps}$$

where p1 and p2 are the probability of feedback on left and right channels respectively, and eps is a constant defining the minimum subband power for which mixing occurs, the threshold power level at which mixing occurs increasing with eps. $m1_i$ is the first filtered subset of frequency sub-bands and $m2_i$ is the second filtered subset of frequency sub-bands. When both p1 and p2 are low, e.g. close to or equal to zero, the above equation simplifies as follows:

$$A_i = \frac{eps}{eps} = 1$$

So, for the left channel, instead of mixing out subbands of the left channel for corresponding subbands of the right channel, the left channel subband will be passed straight through to the speaker with no change when p1 and p2 are both low (i.e. a low probability of feedback in either channel at the subband of interest). Indeed, the mixing coefficient becomes equal to 1 whenever p1 falls to zero such that the subband of interest in the left channel is always passed through when the estimated probability of feedback is zero. When a level difference between the left and right channels is large (due to the presence of feedback in one channel or the other) the feedback detection module 302 may determine a high probability of feedback in one channel or the other. This probability may be increased if a large level difference is detected between error and reference microphones in one of the left and right channels. For example, when the feedback detection module 302 determines a high probability of feedback in a subband of the left channel, p1 may be close to 1 and p2 may be close to zero. In any case, where feedback probability in the left channel is high, i.e. p1 is close to 1 and the feedback probability in the right channel is low, the above equation simplifies to:

$$A_i = \frac{eps}{m1_i^2 + eps}$$

The mixing coefficient is then determined by the level of the left channel. The greater the level of the left channel, the smaller the mixing coefficient and the more of the corresponding subband of the right channel is mixed. When a level difference between the left and right channels is present due to environmental sound coming from a particular angle relative to the user, the level of the effected subband in the left channel may be low. In which case, more of the affected subband in the left channel will be maintained in the output signal and, as such, the mixing ratio $A_i$ is less likely to reduce stereo perception, i.e. less likely to remove perception to the user of the sound coming from the left side of his head.

In addition to level difference, the feedback detection module 302 may also take into account the signal level in the left and right channels for the sub-band of interest. For example, in some instances, when the level difference is caused by head shadowing, the level difference may be high but the signal level itself may be low (relative to the signal level in the presence of feedback). This is in contrast to feedback howling where the signal level in the affected channel is always relatively high.

The mixing module 400 is configured to weight each of the one or more frequency sub-bands i of the first set $m1_i$ with a respective mixing coefficient $A_i$ and weight each of the corresponding frequency sub-bands i, of the second set $m2_i$ with a respective mixing coefficient $(1-A_i)$. The mixing module 400 is further configured to sum each of the weighted one or more frequency sub-bands i of the first set $m1_i$ with corresponding weighted frequency sub-bands i of the second set $m2_i$ together to produce a set $mm_i$ of one or more mixed frequency sub-bands i.

The mixing module 400 may be further configured to combine the mixed set, $mm_i$, of the one or more frequency sub-bands of first signal $S_1$, for example, those frequency sub-bands of first signal $S_1$ which were blocked by the filter 404, to produce the modified output signal $S_M$.

The mixing module 400 may further comprise an inverse DFT module 410 to convert the modified output signal, $S_M$, into a time domain modified output signal, $S_m$. The inverse DFT module 410 may implement any known conversion algorithm, for example, an IFFT.

The mixing module 400 may further comprise a cross fader 412 to mix or blend the modified output signal, $S_m$, with the first signal, $S_1$, to produce the modified output signal, $S_{m1}$. For example, the cross fader 412 may be configured to gradually blend the modified output signal, $S_m$, with the first signal, $S_1$, to minimise an abrupt change in sound distinctly audible to the user.

In the embodiment shown in FIG. 4, mixing coefficients A and 1−A are determined and summed in the frequency domain before being converted by the inverse DFT module 410 into the time domain. In a variation, the mixing module 400 may generate the coefficients in the time domain and apply these time domain coefficients to signals m1 and m2 in the time domain. In which case, the inverse DFT module 410 may be replaced with an inverse DFT module immediately preceding coefficient blocks A and 1−A shown in FIG. 4. In which case blocks A and 1−A would be implemented in the time domain as time domain filters to apply the mixing coefficients. Such filter blocks would be applied to raw input signals S1 and S2. In some embodiments the filter 404 and the filter blocks A, 1−A (when implemented in the time domain) may be combined such that the input signals S1, S2 are filtered in a single step.

In some embodiments, the mixing module 400 is activated or instigated in response to determining that feedback is present at a first speaker associated with the first microphone. For example, in some embodiments, the mixing module 400 is configured to receive an indication of the determination of feedback from the feedback detection module 302. As mentioned above, in some embodiments, the indication may comprise a binary flag indicative of the presence or otherwise of feedback such as howling at the first or second microphones. In some embodiments, the feedback reduction system 300 further comprises the feedback detection module 302.

Referring to FIG. 6, there is shown a process flow diagram depicting a method 500 for reducing feedback in an acoustic system, according to various embodiments of the present disclosure.

At 502, feedback at first speaker associated with first microphone is determined.

Optionally, at 504, a first set of frequency sub-bands of a first signal derived from the first microphone having a frequency of greater than a threshold frequency is determined. Alternatively, the first set of frequency sub-bands of the first signal are received (in the frequency domain) and no conversion is necessary.

Optionally, at 506, a second set of frequency sub-bands of a second signal derived from the second microphone having a frequency of greater than a threshold frequency is determined. Alternatively, the second set of frequency sub-bands of the second signal are received (in the frequency domain) and no conversion is necessary.

At 508, first mixing coefficients $A_i$ for each of the one or more frequency sub-bands i of the first set are determined such that power of the modified output signal is reduced and a stereo effect level difference between the modified output signal and second signal is at within a level difference threshold range. For example, the level difference threshold range may be about 6 to 12 dB.

At 510, each of the one or more frequency sub-bands of the first and second sets are weighted with respective first and second mixing coefficient.

At 512, each of the weighted frequency sub-bands of the first set is summed with corresponding weighted frequency sub-bands of the second set together to produce a mixed set of one or more frequency sub-bands.

At 514, the mixed set of one or more frequency sub-bands is combined with the first signal to produce a modified output signal.

Figure 7:
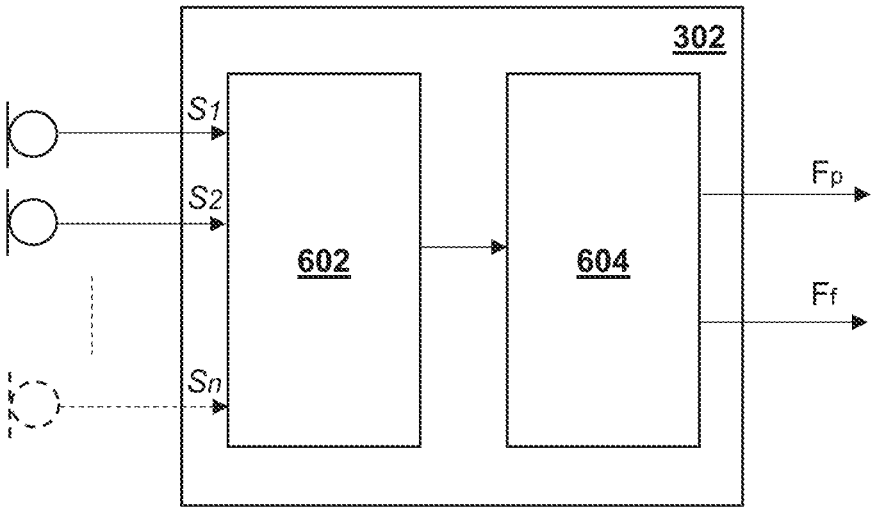
FIG. 7 is a schematic illustration of a feedback detection module.

Referring now to FIG. 7, a block diagram of the feedback detection module 302 according to an exemplary embodiment is illustrated. The feedback detection module 302 is configured to detect feedback noise, such as howling. In some embodiments, the feedback detection module 302 is configured to provide, as an output, a probability indicator, $F_p$ of a likelihood or probability of feedback. Additionally or alternatively, the feedback detection module 302 is configured to provide, as an output, a binary flag, $F_f$, indicative of the presence or absence of feedback noise, such as howling at a speaker of an acoustic system, such as the system 200 of FIG. 2*a*.

As stated above, in some embodiments, the output of the feedback detection module 302 may be provided to the DFBC module 306 shown in FIG. 3 to improve control of feedback in acoustic systems, for example, by adjusting a feedback adaptation rate of a dynamic feedback cancellation algorithm implemented by the DFBC module 306. In prior art feedback cancellation techniques, the adaptation rate of the canceller is adjusted based on the convergence of an internal normalised least mean square (NLMS) filter. An example of such techniques is provided in U.S. Pat. No. 9,271,090 B2 the content of which is hereby incorporated by reference in its entirety. NLMS filters are known in the art so will not be described in detail here. However, in contrast to the operation of conventional NLMS filter implementations, in some embodiments of the present disclosure, the adaptation or learning rate of the NLMS filter may be dynamically adjusted in dependence of the probability of feedback occurring, that probability received from feedback detection module 302. For example, the adaptation rate may be increased if the probability of feedback increases and vice versa.

In some embodiments, the adaptation rate μ is determined by the following equation:

$$\mu=\mathrm{Max}(\mathrm{fbc_slow_rate},(\mathrm{fbc_fast_rate}+\mathrm{logProb})),$$

where logProb is the log probability of feedback occurring (in this case in the left channel), fbc_slow_rate is the lower bound of the adaptation rate μ, and fbc_fast_rate is the upper bound of the adaptation rate μ. In other words, the adaptation rate μ is calculated as the lowest value of the lower bound of the adaptation rate μ on the one hand and the sum of the upper bound of the adaptation rate μ and the log probability of feedback occurring on the other hand. Since the probability of feedback occurring is always less than or equal to 1, logProb will always be negative. As such, the adaptation rate μ is saturated between the lower and upper bound of the adaptation rate μ.

The above is described with reference to NLMS filters. However, the above could equally be implemented using a least means squares (LMS) algorithm or other suitable algorithm. Both NLMS inputs, or both LMS inputs, are preferably decorrelated or whitened by suppression of the correlated signals.

In some embodiments, the output of the feedback detection module 302 may be provided to the cross-ear mixing module 304 to reduce feedback noise by instigating signal mixing to reduce deleterious feedback effects, such as howling, as discussed above.

The feedback detection module 302 comprise a level difference unit 602 for determining a level difference between at least first and second signals, $S_1$, $S_2$, derived from at least first and second microphones (not shown), respectively, associated with one or more speakers (not shown) and a decision function unit 604, such as a logistic regression unit, which may be configured to determine a likelihood or probability of the presence of feedback noise such as howling at a first speaker based on the level difference.

The at least first and second microphones may comprise one or more reference microphones configured to capture ambient sounds and/or one or more error microphones configured to capture sound at respective one or more speakers. In some embodiments, the at least first and second microphones comprise the first and second reference microphones 208, 210 and first and second error microphones 205, 206 of the system 200 shown in FIG. 2*a*.

In some embodiments, the feedback detection module 302 comprises one or more A/D converter (not shown) configured to convert analogue electrical signals received, for example, from analogue microphones into digital signals. In other embodiments, the feedback detection module 302 is configured to receive digital signals.

In some embodiments, the feedback detection module 302 is configured to transform the received first and second signals $S_1$, $S_2$ from the time domain (if received in the time domain) into the frequency domain. In other embodiments, the first and second signals $S_1$, $S_2$ may be received in the frequency domain. In either case, in some embodiments, full-band calibration gains may be applied on the frequency domain data.

During testing of headsets, earphones and earbuds, the inventors observed that feedback howling is most likely to be present at high frequencies and is further likely to be localised. In other words, howling is most likely to occur on one side of a stereo audio system. This is due to the fact that howling is commonly induced by a user touching one side or the other of the audio system (e.g. headset) at a time. The inventors have also discovered that when feedback reduction algorithms are used in the signal path, howling tends to be short lived. Additionally, due to the effect of head shadowing, howling is generally attenuated by over 20 dB when picked up by a microphone on the other side of the headset. In view of the above, exemplary embodiments of the disclosure are configured to monitor levels at microphones associated with audio systems such as the system 200 of FIG. 2*a* to detect differences in levels at those microphones and to determine a probability or binary indication of feedback based on comparisons between levels at those microphones.

In some embodiments, the level difference unit 602 is configured to determine a level difference between the first signal $S_1$ which may be derived from a first reference microphone and a second signal, $S_2$ which may be derived from a second reference microphone. For example, the first and second reference microphones may be first and second (left and right) reference microphones of a headset, earphones or earbuds and the level difference unit 602 may be configured to determine a cross ear level difference. In some embodiments, the level difference unit 602 is configured to determine a level difference between a first signal derived from a first error microphone and a second signal derived from a second error microphone. The level difference unit 602 may equally be able to determine a cross ear level difference from left and right error microphones. In some embodiments, the first error microphone is the error microphone 205 of system 200 and the second error microphone is the error microphone 206 of system 200.

Figure 8:
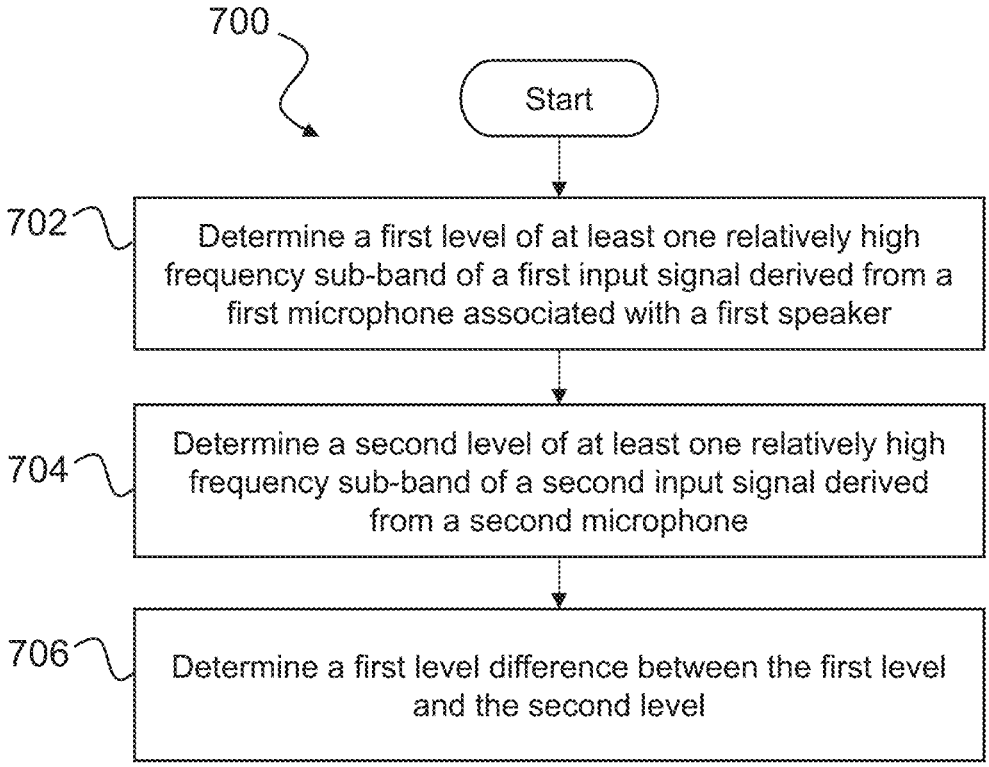
FIG. 8 is a process flow diagram depicting a method for feedback detection in an acoustic system.

Referring to FIG. 8, there is shown a process flow diagram depicting a method 700 for determining a likelihood of feedback noise at a first speaker in an acoustic system, according to various embodiments of the present disclosure.

At 702, a first level of at least one relatively high frequency sub-band of a first input signal derived from a first microphone associated with the first speaker is determined. In some embodiments, the first input signal $S_1$ in the frequency domain is grouped into two frequency sub-bands; a high frequency sub-band and a low frequency sub-band and the first level is the level of the high frequency band. The high frequency band may be chosen to be greater than 2 kHz or greater than 3 kHz. In other embodiments, the level difference module 602 may identify a high frequency sub-band having frequency range greater than a threshold, e.g. greater than 2 kHz or greater than 3 kHz.

At 704, a second level of at least one relatively high frequency sub-band of a second input signal derived from a second microphone of the acoustic system is determined. The at least one relatively high frequency sub-band of the first input signal corresponds with the at least one relatively high frequency sub-band of the second input signal.

At 706, a first level difference between the first level and the second level is determined. In some embodiments, the first level difference is indicative of the dB level difference between the at least one relatively high frequency sub-band of the first and second signals. In some embodiments, the first level difference is feature $X_i$.

In some embodiments, the method 700 further comprises determining a second level difference between a level of at least one relatively low frequency sub-band of the first input signal and a corresponding relatively low frequency sub-band of the second input signal and determining a modified level difference by subtracting the second level difference from the first level difference. In such an embodiment, the likelihood or probability of feedback at the first speaker is determined based on the modified level difference. In some embodiments, the modified level difference is feature $X_i$.

In some embodiments, the method 700 is performed on a first frame of data from the first input signal and a second frame of data from the second input signal. In some embodiments, prior to determining the first and second levels, the first and second frames of data are converted into the frequency domain and full-band calibration gains may be applied to the first and second frames of frequency domain data, as described above.

In audio systems comprising an error microphone and a reference microphone associated with a single speaker, for example the module 202 of FIG. 2*b*, the signal level difference between the error microphone and the reference microphone tends to be relatively high for playback signals and relatively low for environment or ambient sound. For example, during playback, the error microphone signal, which is conventionally positioned within or directed towards the ear canal, can be about 20 dB louder than the signal from the reference microphone, which is conventionally located outside of the ear canal and insulated from the speaker. In the low frequency, the difference may be more than 40 dB. Although level differences can vary from fitting to fitting of headsets, earphones and earbuds, such level differences have been found to be generally a good indicator of feedback.

Accordingly, in some embodiments, in addition to or as an alternative to determining a level difference between two reference microphones or between two error microphones, i.e. a stereo level difference, the level difference unit 602 is configured to determine a level difference between a first signal derived from a first reference microphone and a second signal derived from a first error microphone. The first reference microphone and the first error microphone may be both associated with the same speaker. For example, the first reference microphone and the first error microphone may be associated with the same speaker of a headset, earphones or earbuds, such as the system 200 of FIG. 2*a*, and the level difference unit 602 may be configured to determine a level difference between the error microphone and the reference microphone on each of one or both ears.

Figure 9:
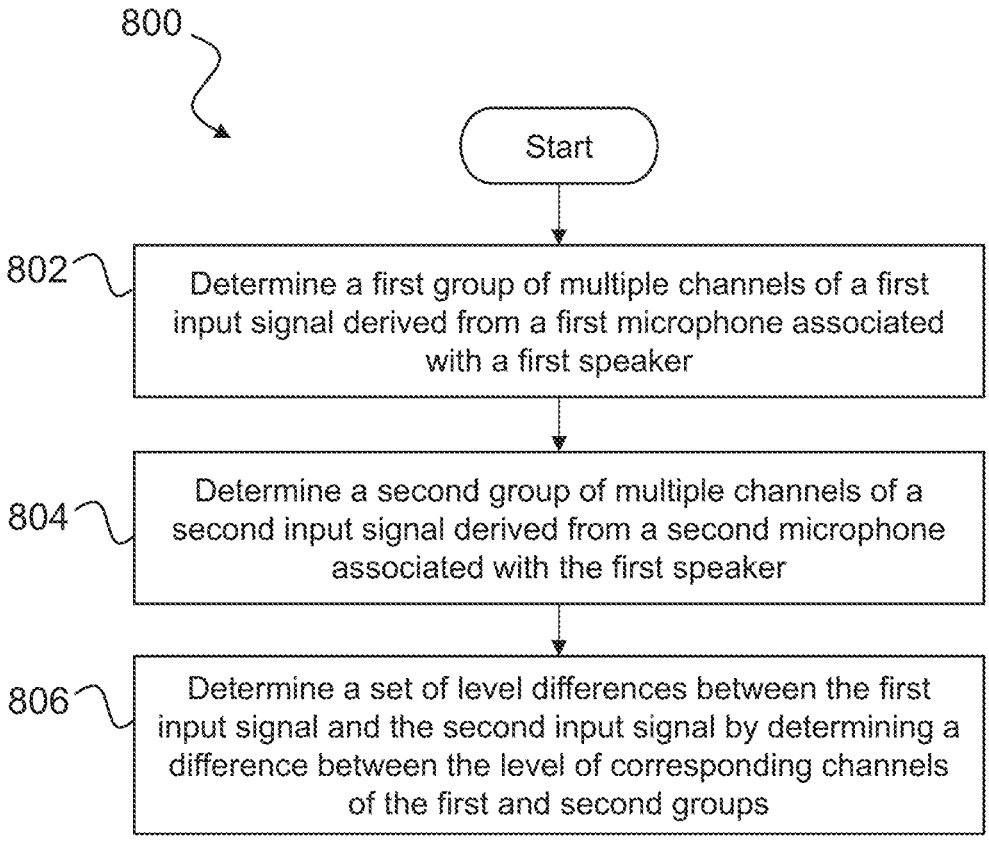
FIG. 9 is a process flow diagram depicting another method for feedback detection in an acoustic system.

Referring to FIG. 9, there is shown a process flow diagram depicting a method 800 for determining a likelihood of feedback noise at a first speaker in an acoustic system, according to various embodiments of the present disclosure.

At 802, a first group of multiple channels of a first input signal derived from a first microphone associated with a first speaker is determined.

At 804, a second group of multiple channels of a second input signal derived from a second microphone associated with the first speaker is determined.

At 806, a set of level differences between the first input signal and the second input signal by determining a difference between the level of corresponding channels of the first and second groups is determined.

In some embodiments, the method 800 is performed on a first frame of data from the first input signal and a second frame of data from the second input signal. In some embodiments, prior to determining the first and second groups of multiple channels, the first and second frames of data are converted into the frequency domain. In some embodiments, full-band calibration gains are applied to the first and second groups of multiple channels to determine calibrated first and second groups and the set of level differences between the first input signal and the second input signal is determined by determining a difference between the dB level of corresponding channels of the calibrated first and second groups.

The decision function unit 604 is configured to determine a likelihood or probability of feedback at the first speaker based on the determined first level difference determined by the level difference unit 602 using process 700 and/or based on the set of level differences determined by process 800.

In some embodiments, determining the likelihood of feedback based on the set of level differences comprises determining a level difference feature $X_i$ based on the mean of the determined set of level differences subtracted by the minimum value of the determined set of level differences and determining the likelihood of feedback based on the level difference feature $X_i$.

In some embodiments, the decision function unit 604 employs logistic regression to determine whether the level difference features, $X_i$, detected by the level difference unit 602 are indicative of the presence of feedback noise such as howling at a speaker of the system.

A predictor function F(X) of the decision function unit 604 may be a linear combination of features $X_i$, where $$F(X) = \frac{1}{1 + e^{-f(X)}}$$

Where $f(X)=\Sigma\ coef_i*X_i+intercept$
and where $coef_i$ and intercept are the linear coefficients.

By applying the logistic function on the predictor function, F(X) is interpreted as the probability of '1' given certain combination of the feature values.

In some embodiments, the linear coefficients may be derived from training data. The training data may comprise two groups of data, namely, data with feedback and data without feedback. For example, the data with feedback may be created by holding a headset in hand and making it howl, (for example, by holding the headset in hand) and labelling any data above about 60 dBSPL as feedback data. The data without feedback may be created by recording the feature data in common false alarm situations, such as own voice, directional environmental sound, clapping hand, etc. and labelling that data as data without feedback. In some embodiments, the ratio between feedback data and no feedback data of the training data is about 1:1.

In some embodiments, the linear coefficients may be derived using a machine learning algorithm, such as a python machine learning algorithm (sklearn: linear_model-.LogisticRegression). Adjustment of the intercept allows for the sensitivity of the detection algorithm to be adjusted as required.

In some embodiments, the decision function unit 604 is configured to output a binary flag $F_f$ indicative of feedback, e.g. to the cross-ear mixing module 304.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A feedback canceller, comprising:
- a first input for receiving a first signal derived from a first microphone associated with a first channel;
- a second input for receiving a first probability of feedback between the first microphone and a first speaker;
- a normalised least mean squares (NLMS) filter configured to filter the first signal and output a filtered first signal; and
- a controller configured to control an adaption rate of the NLMS filter in dependence of the first probability of feedbacks;
- wherein the first probability of feedback is determined by comparing a signal level difference between the first signal and a second signal derived from a second microphone associated with a second channel.

2. The feedback canceller of claim 1, wherein the controller is configured to increase the adaption rate of the NLMS filter as the first probability of feedback increases.

3. The feedback canceller of claim 2, wherein the controller is configured to control the adaption rate, μ, using the following equation:

$$\mu=Max(fbc_slow_rate,(fbc_fast_rate+log\ Prob))$$

where fbc_slow_rate is a lower bound of the adaption rate, fbc_fast_rate is an upper bound of the adaptation rate, and logProb is the log of the first probability.

4. An electronic device comprising the feedback canceller according to claim 1.

5. The electronic device of claim 4, wherein the electronic device is: a mobile phone, a smartphone, a media playback device, an audio player, a mobile computing platform, a laptop or a tablet computer.

6. The feedback canceller of claim 1, wherein the first microphone is a first reference microphone and the second microphone is a second reference microphone.

7. The feedback canceller of claim 1, wherein the first microphone is a first error microphone and the second microphone is a second error microphone.

8. The feedback canceller of claim 1, wherein the first and second microphones are right and left microphones of a headset, earphones or earbuds, and the signal level difference is a cross ear level difference from the right and left microphones.

9. A method of cancelling feedback, comprising:
- receiving a first signal derived from a first microphone associated with a first channel;
- receiving a first probability of feedback between the first microphone and a first speaker; and
- filtering the first signal with a normalised least mean squares (NLMS) filter and outputting a filtered first signal;
- wherein an adaption rate of the NLMS filter is controlled in dependence of the first probability of feedback;
- wherein the first probability of feedback is determined by comparing a signal level difference between the first signal and a second signal derived from a second microphone associated with a second channel.

10. The method of claim 9, wherein the adaption rate of the NLMS filter is increased as the first probability of feedback increases.

11. The method of claim 10, wherein the adaption rate, μ, is controlled based on the following equation:

$$\mu=Max(fbc_slow_rate,(fbc_fast_rate+log\ Prob))$$

where fbc_slow_rate is a lower bound of the adaption rate, fbc_fast_rate is an upper bound of the adaptation rate, and logProb is the log of the first probability.

12. The method of claim 9, wherein the first microphone is a first reference microphone and the second microphone is a second reference microphone.

13. The method of claim 9, wherein the first microphone is a first error microphone and the second microphone is a second error microphone.

14. The method of claim 9, wherein the first and second microphones are right and left microphones of a headset, earphones or earbuds, and the signal level difference is a cross ear level difference from the right and left microphones.

15. A non-transitory computer-readable storage medium comprising instructions which, when executed by a computer, cause the computer to carry out a method comprising:
- receiving a first signal derived from a first microphone associated with a first channel;
- receiving a first probability of feedback between the first microphone and a first speaker; and
- filtering the first signal with a normalised least mean squares (NLMS) filter and outputting a filtered first signal;
- wherein an adaption rate of the NLMS filter is controlled in dependence of the first probability of feedback; and
- wherein the first probability of feedback is determined by comparing a signal level difference between the first signal and a second signal derived from a second microphone associated with a second channel.

16. The non-transitory computer-readable storage medium of claim 15, wherein the adaption rate of the NLMS filter is increased as the first probability of feedback increases.

17. The non-transitory computer-readable storage medium of claim 16, wherein the adaption rate, μ, is controlled based on the following equation:

$$\mu = \mathrm{Max}(\mathrm{fbc_slow_rate}, (\mathrm{fbc_fast_rate} + \log \mathrm{Prob}))$$

where fbc_slow_rate is a lower bound of the adaption rate, fbc_fast_rate is an upper bound of the adaptation rate, and logProb is the log of the first probability.

18. The non-transitory computer-readable storage medium of claim 15, wherein the first microphone is a first reference microphone and the second microphone is a second reference microphone.

19. The non-transitory computer-readable storage medium of claim 15, wherein the first microphone is a first error microphone and the second microphone is a second error microphone.

20. The non-transitory computer-readable storage medium of claim 15, wherein the first and second microphones are right and left microphones of a headset, earphones or earbuds, and the signal level difference is a cross ear level difference from the right and left microphones.

* * * * *